US006654973B2

(12) United States Patent
Van Den Heuvel et al.

(10) Patent No.: US 6,654,973 B2
(45) Date of Patent: Dec. 2, 2003

(54) MOBILE LIFT-ASSISTED PATIENT TRANSPORT DEVICE

(75) Inventors: Christian Van Den Heuvel, Santa Barbara, CA (US); Francis M. LeGasse, Rochester Hills, MI (US); Jeffrey R. Hattem, Stuart, FL (US); Joseph L. LeGasse, Rochester Hills, MI (US); Michael Catoe, Lexington, SC (US)

(73) Assignee: Tech Lift, Inc., Phoenixville, PA (US)

( * ) Notice: Subject to any disclaimer, the term of this patent is extended or adjusted under 35 U.S.C. 154(b) by 0 days.

(21) Appl. No.: 09/863,284

(22) Filed: May 24, 2001

(65) Prior Publication Data

US 2002/0174486 A1 Nov. 28, 2002

(51) Int. Cl.[7] ..... A61G 1/00; A61G 7/012

(52) U.S. Cl. ..... 5/611; 5/86.1; 296/20; 254/93 R

(58) Field of Search ..... 5/11, 611, 614, 5/615, 86.1; 296/20; 254/93 R, 93 L, 93 HP

(56) References Cited

U.S. PATENT DOCUMENTS 2,610,824 A * 9/1952 Grier ..... 254/93 HP
2,833,587 A * 5/1958 Saunders ..... 182/69.5
3,174,722 A * 3/1965 Alm ..... 108/147
4,078,269 A * 3/1978 Weipert ..... 254/122
4,159,822 A * 7/1979 Ota et al. ..... 5/614
4,323,141 A * 4/1982 Ragan et al. ..... 187/204
5,022,105 A * 6/1991 Catoe ..... 296/20
5,271,113 A * 12/1993 White ..... 254/126
5,365,622 A * 11/1994 Schirmer ..... 5/611

* cited by examiner

*Primary Examiner*—Michael F. Trettel
(74) *Attorney, Agent, or Firm*—Burns, Doane, Swecker & Mathis, L.L.P.

(57) ABSTRACT

A lift-assisted device including a seat portion; a seat support portion which supports the seat portion; a base portion; an undercarriage portion which comprises of at least one scissor linkage member, each scissor linkage member including a first member pivotable connected to a second member near a center portion of the first and second member; a pneumatic bag located between the seat portion and the base portion; a pneumatic cylinder located between the seat portion and the base portion; a pneumatic powering means for powering the pneumatic bag and/or pneumatic cylinder and wherein the first member and second member are slidably connected to the seat portion on one end and fixedly connected to the base portion on an opposite end.

18 Claims, 8 Drawing Sheets

MOBILE LIFT-ASSISTED PATIENT TRANSPORT DEVICE

FIELD OF THE INVENTION

The present invention relates generally to mobile lift-assisted transport devices. More specifically, the present invention relates to a mobile lift-assisted transport device which is able to easily be elevated and lowered through the use of pneumatic powering means.

BACKGROUND OF THE INVENTION

A busy Emergency Medical Services (EMS) crew may handle as many as 20 calls during the work shift. Typically one or more such calls involve moving a patient from a field location, such as his home or the scene of an accident, to a health care facility such as an emergency room at a hospital.

Providing transport for the patient involves various procedures for appropriately securing the patient in different transport vehicles for transport to the hospital or other appropriate destination. Such transport involves a constant risk to the EMS crew and to the patient. The risk arises from the activity involving the EMS crew, usually two persons, lifting and moving the patients. There is also the danger that the patient may be dropped or roughly handled while being moved. As for the EMS crew, they are routinely faced with lifting situations which can and often do result in significant and even crippling back injuries. This can occur either because of the repetitive lifting of average size patients or occasional lifting of large patients.

The dangers of lifting-related injury is compounded because an EMS crew must lift a patient approximately 7 times during the course of a call. For example, for lifting purposes only, in an emergency involving a 200 lb. man the crew must: 1) lift the patient to a mobile, wheeled device placed at its lowest height adjustment; 2) lift the device and patient to the maximum height adjustment, and then move the device and patient to an ambulance; 3) lower the device and patient back to the lowest height adjustment; 4) lift the device and patient into the ambulance; 5) upon arrival at the medical facility, remove the device and patient from the ambulance and lower them to the ground; 6) again, lift the device and patient to the maximum height adjustment, and then move the device and patient into the facility; and 7) lift to transfer the patient from the device to a bed at the facility. During this very typical call the crew has lifted or lowered the patient seven times, thereby doing an amount of work equivalent to lifting more than 1400 pounds when the weight of the device is included.

A particularly difficult part of this process results from the fact that the typical device that is used in the field, e.g., a stretcher for transfer of patients via ambulances, is not well-designed for lifting and lowering. Because of the location of the undercarriage and supporting structure, the members of the EMS crew cannot simply stand on each side of the device and lift or lower it using proper lifting techniques with their legs. Rather, to avoid hitting the undercarriage with their knees, they must turn their bodies sideways, imposing a torquing motion on their backs as they lift and lower. This consequence results in a significant number of disabling back injuries to EMS personnel each year. In addition, because of the strength that is required to lift and lower a device with this type of motion, smaller people, particularly women, are effectively precluded from working as emergency medical technicians.

The foregoing illustrates that it would be advantageous to provide a patient transport device having a lift assisting mechanism, to overcome the need for an EMS crew to exert a great amount of lifting force during a routine emergency call.

Although several such transport devices have been proposed, all are too cumbersome to be practically implemented. One example of such a device is found in U.S. Pat. No. 2,833,587 to Saunders which discloses an adjustable height gurney which includes power cylinders provided in the legs of the upper frame and connected to two of the intersecting lever arms (one on each side of the gurney). To operate the cylinders, the EMS technician repeatedly works the handle of a grip up and down to actuate the hydraulic pump. As an alternative, a valve connects the power cylinders to the fluid reservoir, which valve may be opened by a hand lever connected thereto. Both mechanisms for actuating the hydraulic pump cause problems in operation. Use of the handle, which requires repeatedly working the handle up and down is time consuming and be quite difficult when a patient is on a gurney. Further, in order to remove the gurney from the ambulance, or to place it in the ambulance, the EMS technicians must lift the stretcher, and the patient, from the ambulance to the ground, and visa versa. Then the technicians can use the grip or hand lever to raise the upper carriage. the gurney in the Saunders patent does not provide a means for raising and lowering the lower carriage, in addition to raising and lowering the upper carriage.

SUMMARY OF THE INVENTION

The present invention provides a novel lift-assisted device for transporting objects or patients from one location to another. The present invention allows the lift-assisted apparatus to easily be raised and lowered through pneumatic powering means so that the user has to use little force or energy.

The present invention provides a novel lift-assisted device which is able to lift and lower heavy loads while enduring the stress and strains caused by the heavy loads.

The present invention provides a novel lift-assisted device wherein the powering means is easily accessible, reasonably priced and may easily be replaced.

The present invention provides the above advantages, amongst others, by providing a lift-assisted device having a seat portion, a seat support portion which supports the seat portion, a base portion, an undercarriage portion which comprises of at least one scissor linkage member, each scissor linkage member including a first member pivotable connected to a second member near a center portion of the first and second member, a pneumatic bag located between the seat portion and the base portion, a pneumatic cylinder located between the seat portion and the base portion, a pneumatic powering means for powering the pneumatic bag and/or pneumatic cylinder, and wherein the first member and second member are slidably connected to the seat portion on one end and fixedly connected to the base portion on an opposite end.

BRIEF DESCRIPTION OF THE DRAWINGS

Preferred embodiment/s of the invention is/are disclosed in the following description and illustrated in the accompanying drawings, in which.

DETAILED DESCRIPTION OF THE PREFERRED EMBODIMENTS

Figure 1:
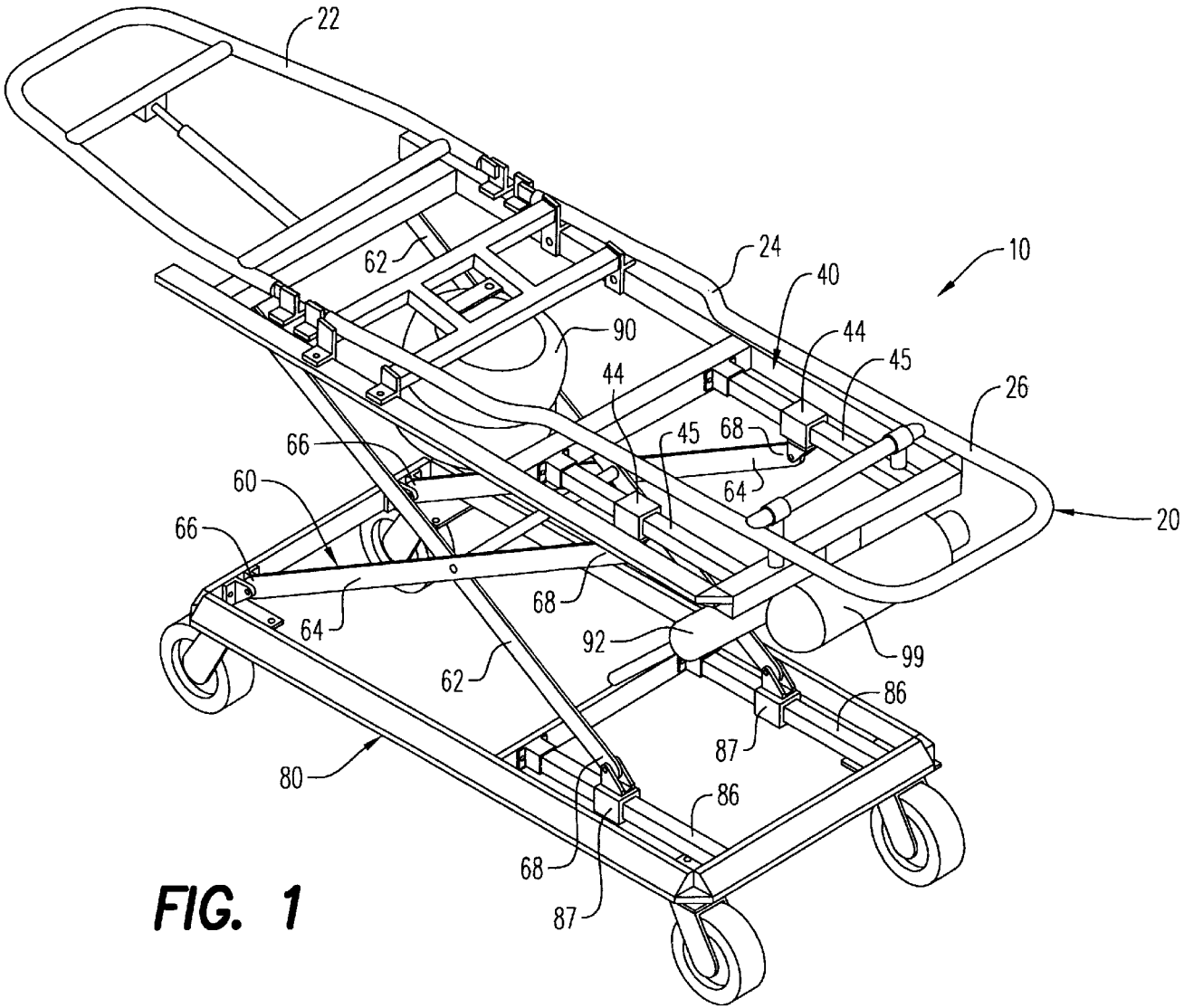
FIG. 1 is a perspective view of an exemplary embodiment of a lift-assisted device according to the present invention.

FIG. 1 illustrates a perspective view of an exemplary embodiment of a mobile lift-assisted device 10. The mobile lift-assisted device 10 is generally used to transport patients from one location to another, while allowing a patient to be placed in a desired position. Furthermore, the mobile lift-assisted device 10 is able to elevate and lower an object or person to a desired height.

As shown in the exemplary embodiment in FIG. 1, the lift-assisted device 10 generally includes four main structural portions which include: a seat portion 20, a seat support portion 40, an under carriage portion 60 and a base portion 80. Additionally, to aid the lift-assisted device 10 in being raised and lowered, as desired, an pneumatic bag 90, a pneumatic cylinder 92 and a pneumatic powering means 99 are provided.

As shown in FIG. 1, the seat portion 20 has a rectangular shape, when the seat portion 20 is in a flat position. The seat portion 20 includes a first end portion 22, a middle portion 24 and a second end portion 26. In the exemplary embodiment, the first end portion 22 and the second end portion 26 are able to be elevated or lowered to either allow the patient to be positioned so that his upper body is in an upright position and/or to have his legs in an upright or downward position. The seat portion 20 includes a cushioning means (not shown) which would be located above the seat portion 20 SO that a user is able to be comfortably positioned on the cushioning means while being transported on the lift-assisted device 10.

The under carriage portion 60 comprises a pair of scissor linkages 62 and 64. Each scissor linkage has a fixed end 66 and a movable end 68. When the lift-assisted device 10 is in an upright position as shown in FIG. 1 the scissor linkages 62 and 64 appear to have an "x" configuration. However, when the lift-assisted device 10 is in a lowered position, each link of the scissor linkages 62 and 64 are essentially parallel to one another.

Figure 2:
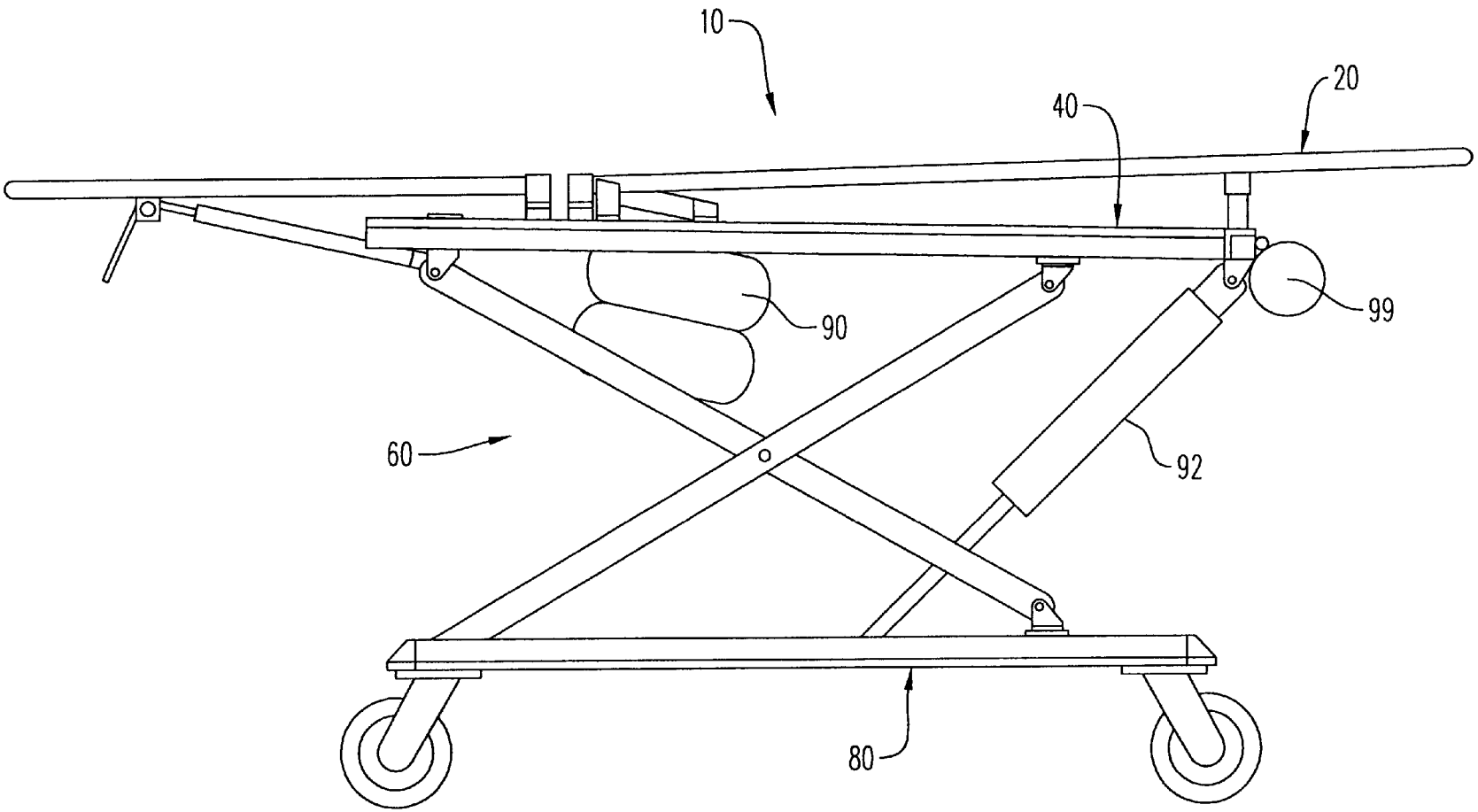
FIG. 2 is side view of the lift-assisted device.

FIG. 2 illustrates a side view of the exemplary embodiment shown in FIG. 1. As shown in FIG. 2, the lift-assisted device 10 includes at least one air bag 90 and at least one pneumatic means 92 located between the seat support portion 40 and the base portion 80. As shown in FIGS. 1 and 2, in an exemplary embodiment the pneumatic means 92 has a first end attached to the base portion 80 and the opposite end attached to the seat support portion 40. The pneumatic means includes a pneumatic air cylinder 92 and is powered by compressed gas which is readily available in most EMS environments.

The pneumatic cylinder 92 is provided with compressed air by any device known to one skilled in the art to supply compressed air. In the exemplary embodiment, a tank 99 of oxygen is positioned underneath the seat portion 20 and attached to the seat support portion 40. In a preferred embodiment, the tank is a S.C.U.B.A. cylinder. The advantage of using such a tank is that this type of tank is non-corrosive, is readily available and is non-flammable. Another advantage is that emergency medical technicians generally have compressed oxygen with them on emergency calls. One advantage, amongst others, of positioning the tank 99 under the seat portion 20 is to protect the tank from various types of fluids or other substances from coming into contact with the tank, e.g. rain, blood, etc. The tank 99 of the compressed gas can be easily connected to the pneumatic cylinder 92, and a suitable valve on the tank 99 may be opened and closed to assist in raising and lowering the patient transport device during use.

As shown in FIGS. 1 and 2, the exemplary embodiment also includes an inflatable device which is a pneumatic bag 90. Similar to the pneumatic cylinder 92, the pneumatic bag is powered by compressed gas which is supplied by the tank 99. The pneumatic bag 90 is also positioned below the seat support portion 40 so as to be protected from various types of fluids or other objects which could damage the pneumatic bag during use of the lift-assisted device 10.

In the exemplary embodiment, a closed circuit is provided between the pneumatic bag 90, pneumatic cylinder 92 and the tank 99. However, it should be appreciated that the pneumatic cylinder and the pneumatic bag may be powered by individual tanks.

Figure 3:
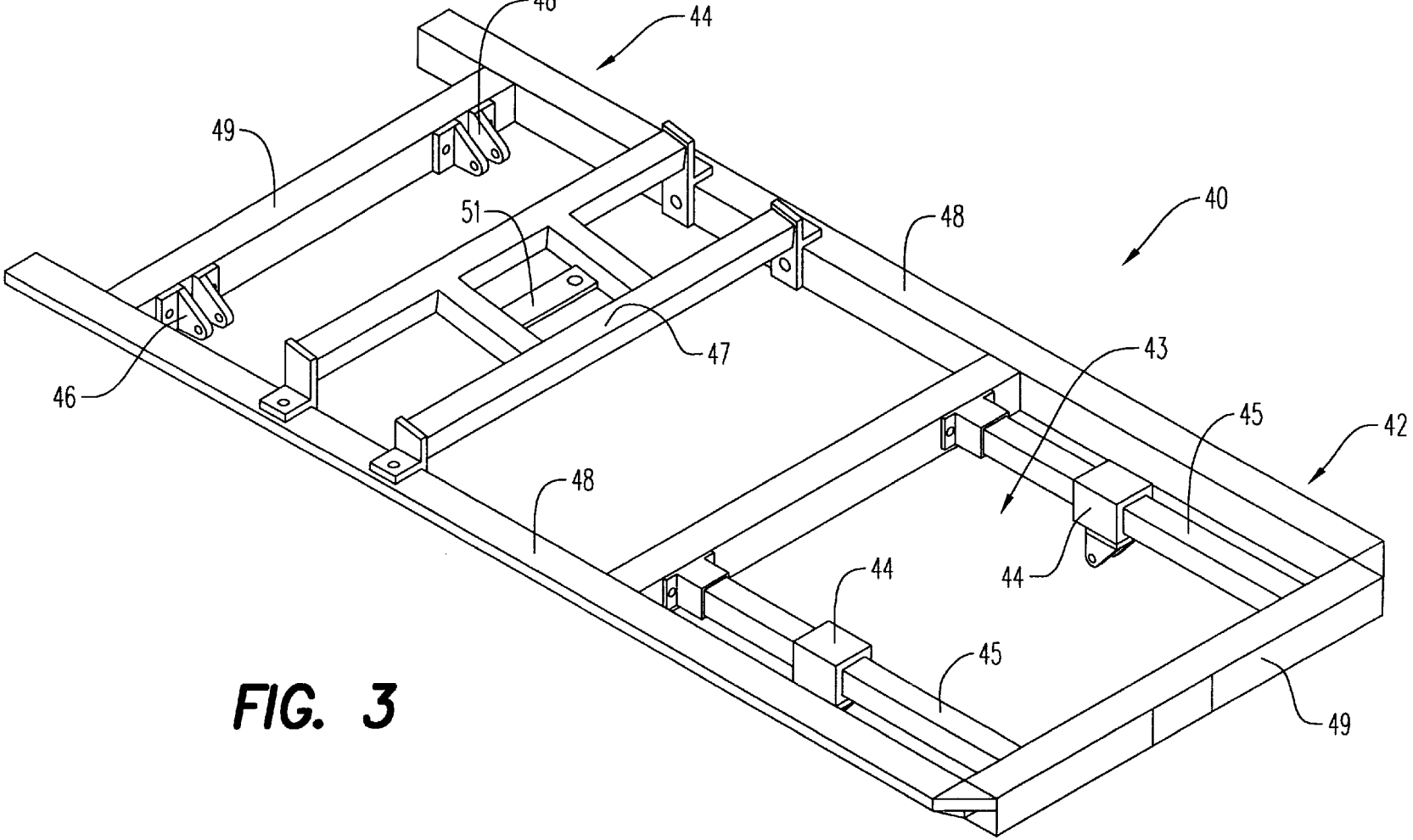
FIG. 3 is a perspective view of the seat support portion of the lift-assisted device.

FIG. 3 illustrates a perspective view of the seat support portion 40. As shown in FIGS. 1 and 3, the seat support portion 40 also has a rectangular shape. The seat support portion 40 includes two side frames 48 and two end frames 49. The seat support portion 40 includes a front portion 42 and a rear portion 44. Located near the front portion 42 is a slidable connection means 43. The slidable connection means 43 comprises of two track members 44 which are slidably connected to two brackets 45, respectively. In the exemplary embodiment, the track members 44 include a plurality of bearings which allow the track members 44 to smoothly slide along the respective bracket 45. The movable end 68 of the linkages 62 and 64 is connected to the respective track member 44 and the fixed end 66 of the linkages is fixed to fixed connected means 46.

As shown in FIG. 3, located between the front portion 42 and the rear portion 44 is a connection means 47. The purpose of the connection means 47 is to hold and support the pneumatic bag 90 shown in FIG. 1. The pneumatic bag 90 is connected to the attachment member 51.

Figure 4:
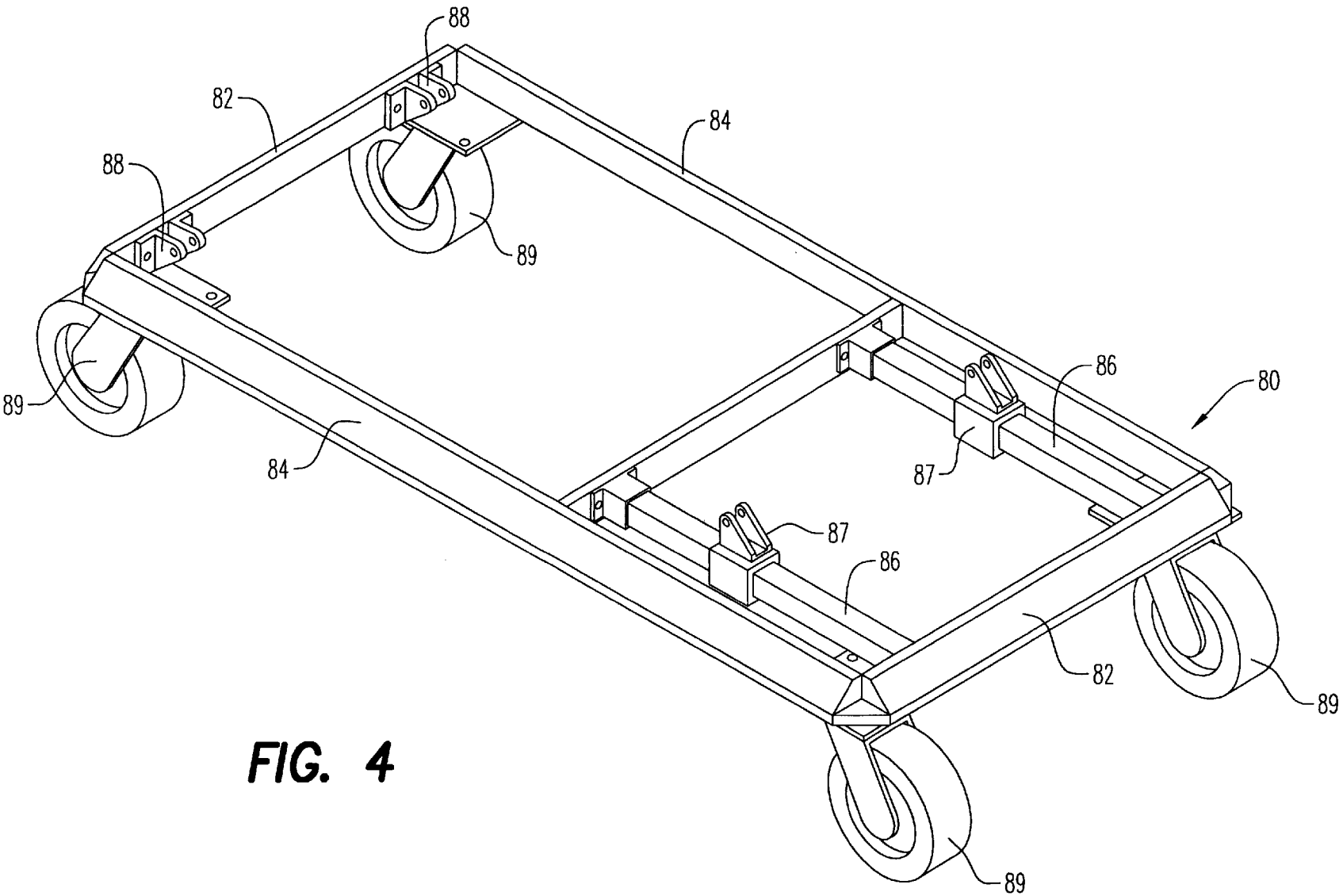
FIG. 4 is a perspective view of the base portion of the lift-assisted device.

FIG. 4. illustrates a perspective view of the base portion 80. The base portion 80 has a plurality of wheels 89 located at the corners of the base portion 80. The wheels are pivotable connected to the base portion 80. The base portion 80 also includes two end frame members 82 and two side members 84. On one end of the base portion are two railings 86 which are positioned essentially parallel to each other. Guide members 87 are located on each railing 86 and are able to slide back and forth along its respective railing 86. On the opposite end of the base portion 80 is connection means 88. The movable end 68 of the links 62 and 64 is connected to the respective guide member 87 and the fixed end 66 of the linkages is fixed to the connection means 88.

Figure 5:
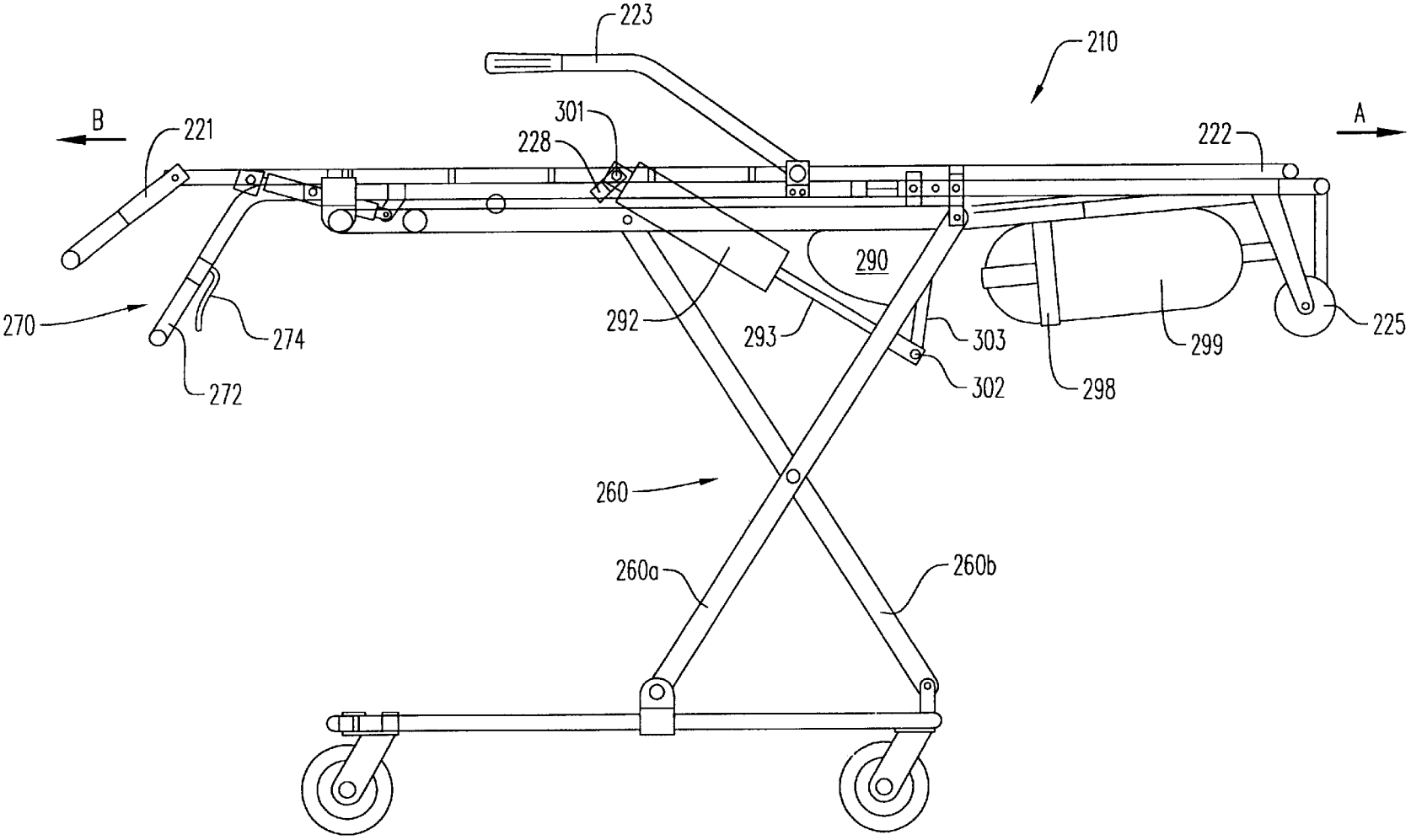
FIG. 5 is a side view of another exemplary embodiment of a lift-assisted device.

FIG. 5 illustrates another exemplary embodiment of a lift-assisted device 210. The lift-assisted device shown in FIG. 5 is in an upright or raised position. Similar to the lift-assisted device shown in FIG. 1, the lift-assisted device 210 also includes a pneumatic bag 290 and a pneumatic cylinder 292 which are powered by an air supply device 299. The lift-assisted device 210 includes a seat portion 220, a seat support portion 240, an undercarriage portion 260 and a base portion 280. The undercarriage portion 260 is located between the seat support portion 240 and the base portion 280.

The lift-assisted device 210 includes a holding device 298 which the air supply device 299 may be secured into and easily removed from. Also the seat portion 220 includes end portions 221 and 222 which are able to extend upwards and downwards. It should be appreciated that the seat support portion 40 may comprise one unitary frame which is detachable from the lift-assisted device 220. A wheel 225 is provided on the seat support portion 240 which is able to extend outwards and inwards as indicated by arrows B and A, respectively. A hand rail 223 is attached to either the seat portion 220 and/or seat support portion 240. As shown in FIG. 5, a control means 270 is provided on one end of the lift-assisted device 210. It should be appreciated that the lift-assisted device 210 could have more than one control means 270 located at any desired location on the lift-assisted device. However, in a preferred embodiment the control means 270 is located at at least one end of the lift-assisted device so that a person, e.g. EMS crew member, may easily have access to the control means 270 to either raise or lower the seat portion to the desired height.

The control means 270 comprises a handle bar member 272 and a lever 274. In an exemplary embodiment, the lift-assisted device 210 includes at least two handle bar members 272 each having a lever. In an exemplary embodiment, one of the handle bar member/lever combinations would allow the user to squeeze the lever to allow air to flow into the pneumatic bag 290 and the pneumatic cylinder 292 from the tank 299, so that the pneumatic cylinder and pneumatic bag are expanded and raise the height of the lift-assisted device 210. Whereas, the other handle bar/lever combination would allow the user to squeeze the lever to allow the air to be exited from the pneumatic bag 290 and the pneumatic cylinder 292 so that the lift-assisted device is lowered to the desired height.

Figure 6:
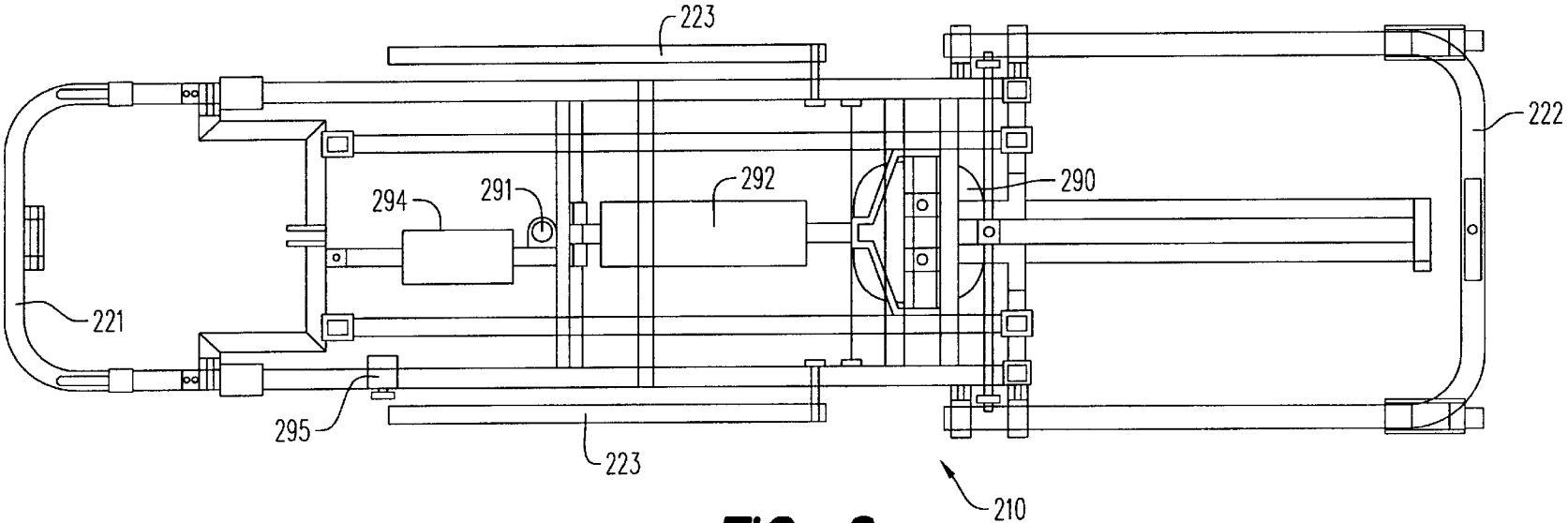
FIG. 6 is a top view of the lift-assisted device as shown in FIG. 5.

The pneumatic bag 290, pneumatic cylinder 292 and tank 299 are connected in a closed system. Within the closed system is a plurality of devices which assist in monitoring and controlling the air pressure within the system. For example, as shown in FIG. 6, in the exemplary embodiment the lift-assisted device includes a control valve 294 and a regulator 291 which assist in controlling the various pressure changes occurring within the closed system. Furthermore, emergency release valves 295 may be located at various locations on the lift-assisted device 210.

In an exemplary embodiment, the control valve is a high flow valve which allows the pneumatic bag 290 to release the compressed air which has filled up the pneumatic bag 290.

Figure 7:
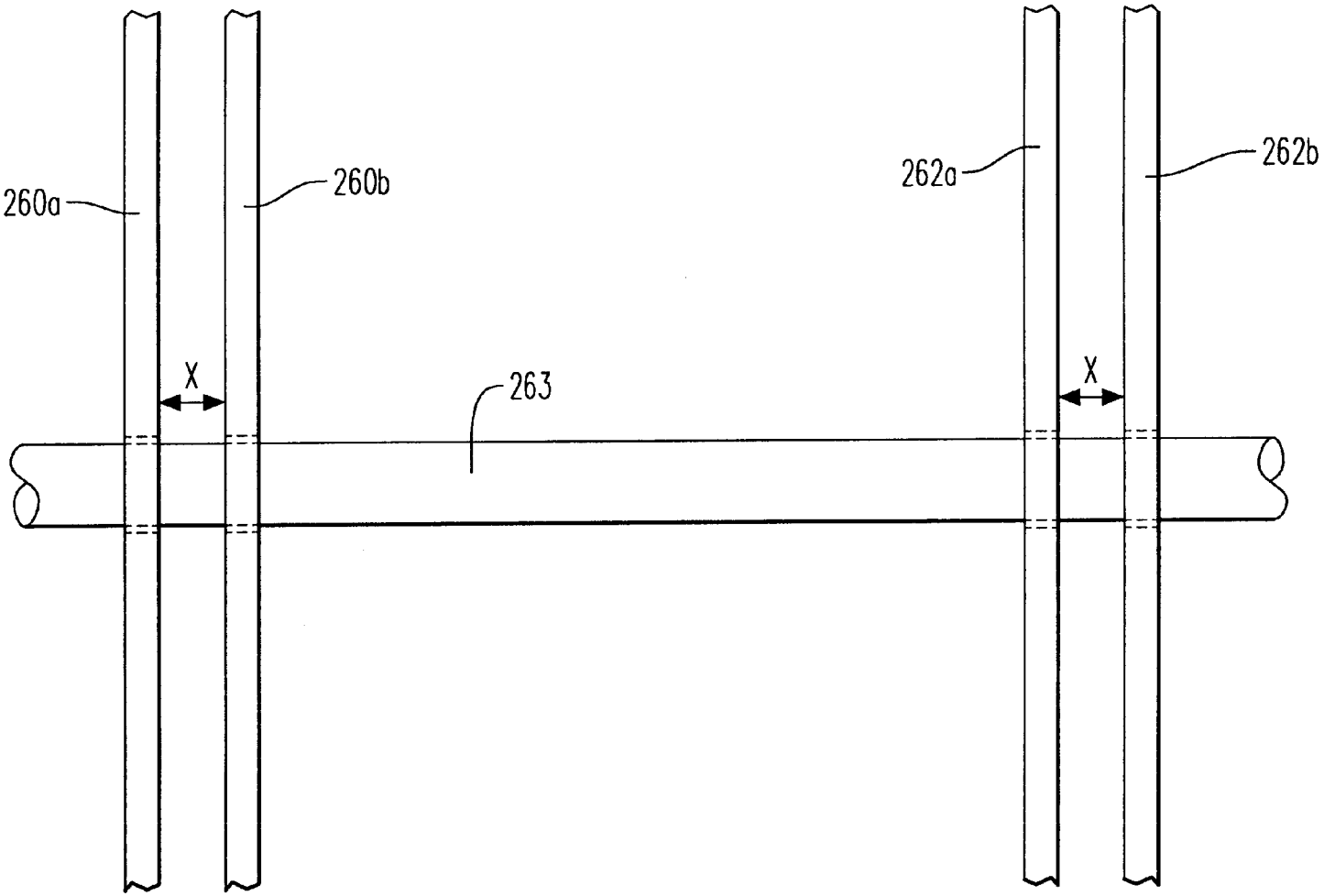
FIG. 7 is a top view of the scissor linkage.

The undercarriage portion 260 comprises of at least one scissor linkage which includes a first member 260*a* and a second member 260*b*. As shown in FIGS. 5 and 7, the first member 260*a* and the second member 260*b* are rotatably connected to a shaft 263. When the seat portion 220 is being raised and lowered the first member 260*a* and the second member 260*b* are rotating in the opposite direction, i.e. when the first member 260*a* is rotating clockwise, the second member 260*b* is rotating counter-clockwise and vise-versa. Furthermore, the first member 260*a* and the second member 260*b* are separated by a predetermined distance x. Preferably, the distance x between the first member 260*a* and the second member 260*b* is in the range of about 1 to 2 inches, but in a preferred embodiment about 1⅝ inches.

In the exemplary embodiment shown in FIG. 5, one end of the pneumatic cylinder 292 is pivotally connected 301 to a connecting member 228, e.g. bracket, located on either the seat portion 220 or the seat support portion 240. The opposite end of the pneumatic cylinder 292 is pivotally connected 302 to a shaft 303 which is connected to the under carriage portion 260. As compressed air is supplied to the pneumatic cylinder 292 the shaft portion 293 is extended outwards from the body 294.

The pneumatic bag 290 is connected to either the seat portion 220 or the seat support portion 240, but preferably to the seat support portion 240. It should be appreciated that the pneumatic bag and pneumatic cylinder may be located anywhere between the seat portion and base portion. Furthermore, it is preferable to position the pneumatic bag 290 to be positioned between the first and second members of the scissor linkage and attached to either the seat support portion or the base portion. Thus, as compressed air is supplied to the pneumatic bag 290 and the pneumatic bag 290 begins to expand, the pneumatic bag 290 will exert a force onto the first and second member forcing the members to separate and raise the lift-assisted device to the desired height.

Figure 8:
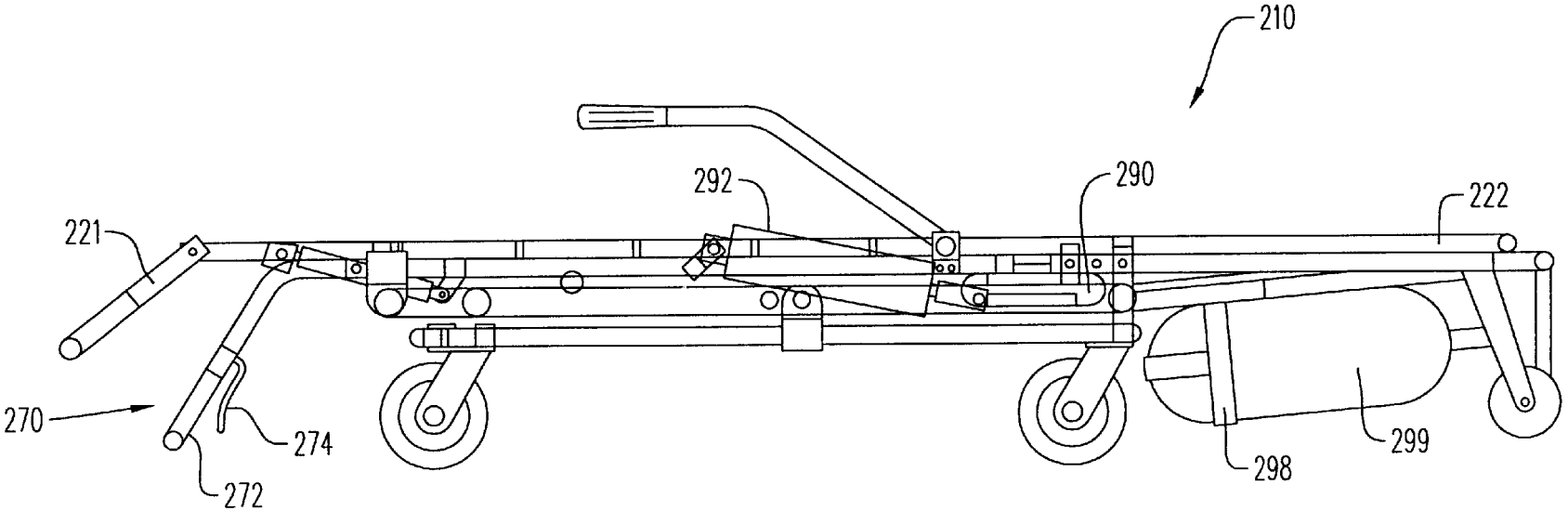
FIG. 8 is a side view of the lift-assisted device as shown in FIG. 5 in a lowered position.

FIG. 8 illustrates a side view of the lift-assisted device 210 in a lowered position when the pneumatic bag 290 is fully deflated and the shaft 293 of the hydraulic cylinder 292 is fully retracted. As compressed air is supplied from the tank 299 to the pneumatic bag 290 and the pneumatic cylinder 292, this causes each of the devices to expand outwards causing the scissor linkage to raise the height of the seat portion 220.

One of the advantages the present invention provides is that it allows the lift-assisted device 210 to be lowered as close as possible to the ground because of its compact configuration. Furthermore, because of the force provided by the pneumatic bag 290 when the lift-assisted device 210 is in the lowered position shown in FIG. 8, the pneumatic cylinder 292 is able to be positioned essentially parallel with the base portion and the seat portion.

What is claimed is:

1. A lift-assisted device, comprising:

a seat portion;

a seat support portion which supports the seat portion;

a base portion;

an undercarriage portion which comprises of at least one scissor linkage member, each at least one scissor linkage member including a first member pivotable connected to a second member near a center portion of the first and second member;

a pneumatic bag located between the seat portion and the base portion;

a pneumatic cylinder located between the seat portion and the base portion;

means for powering the pneumatic bag and/or pneumatic cylinder; and wherein the first member and second member are slidably connected to the seat portion on one end of the first member and the second member and fixedly connected to the base portion on an opposite end of the first member and the second member.

2. The lift-assisted device according to claim 1, wherein the pneumatic bag comprises an elastic rubber bag.

3. The lift-assisted device according to claim 1, wherein the means for powering comprises a S.C.U.B.A. tank.

4. The lift-assisted device according to claim 1, wherein the seat portion has a telescoping portion on at least one end of the seat portion.

5. The lift-assisted device according to claim 1, wherein the pneumatic cylinder is pivotably connected to the seat support portion on one end and pivotably connected to the undercarriage portion on the other end.

6. The lift-assisted device according to claim 1, wherein the pneumatic bag, pneumatic cylinder and the means for powering are in a closed system.

7. The lift-assisted device according to claim 6, wherein the closed system further includes a control valve and a regulator to control the pressure within the closed system.

8. The lift-assisted device according to claim 6, wherein the closed system further includes a release valve.

9. The lift-assisted device according to claim 1, wherein the pneumatic cylinder is pivotably connected to the seat portion on one end and pivotably connected to the under carriage portion on an other end.

10. The lift-assisted device according to claim 1, wherein the first member and the second member of the scissor linkage member are spaced apart by a desired distance.

11. The lift-assisted device according to claim 10, wherein the desired distance is in the range of about 1 inch to about 2 inches.

12. The lift-assisted device according to claim 1, wherein the seat support portion includes at least one wheel.

13. The lift-assisted device according to claim 1, wherein the base portion includes a plurality of wheels which are pivotably connected to the base portion.

14. The lift-assisted device according to claim 1, wherein the seat portion is detachable from the lift-assisted device.

15. The lift-assisted device according to claim 1, wherein the seat support portion includes a holding means to which the powering means may be releasably attached.

16. A method of raising a lift-assisted device, comprising providing a lift-assisted device having scissor linkage member;

providing compressed air to a pneumatic bag and pneumatic cylinder to provide driving forces to lift the lift-assisted device to a desired height, wherein each of said pneumatic bag and said pneumatic cylinder provides the driving forces.

17. The method according to claim 16, wherein providing compressed air to the pneumatic bag and pneumatic cylinder occurs simultaneously.

18. The method according to claim 16, wherein a control means is provided to monitor the pressure within a closed system formed from the pneumatic bag, pneumatic cylinder and powering means.

* * * * *